US007370782B2

(12) United States Patent
Thompson et al.

(10) Patent No.: US 7,370,782 B2
(45) Date of Patent: May 13, 2008

(54) TAPE DISPENSER

(75) Inventors: Craig Thompson, Inver Grove Heights, MN (US); Dennis L. Crawford, Roberts, WI (US); Peter Newbould, Milan (IT); Sigurdur Thorsteinsson, Milan (IT); Steven E. Turch, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 171 days.

(21) Appl. No.: 11/098,291

(22) Filed: Apr. 4, 2005

(65) Prior Publication Data

US 2006/0219748 A1 Oct. 5, 2006

(51) Int. Cl.
*B26F 3/02* (2006.01)

(52) U.S. Cl. ..... 225/6; 225/77; 156/577; 156/579

(58) Field of Classification Search ..... 225/16, 225/77, 56, 57, 65, 66, 6; D19/69, 67; 156/577, 156/579, 574, 527; 242/589.2, 589.3, 598, 242/599; 403/376, 380
See application file for complete search history.

(56) References Cited

U.S. PATENT DOCUMENTS

| | | | | |
|---|---|---|---|---|
| 3,134,526 | A | | 5/1964 | Schleicher |
| 3,149,764 | A | | 9/1964 | Waltz |
| 3,968,915 | A | | 7/1976 | Schleicher |
| D259,643 | S | | 6/1981 | Pearson |
| 4,627,560 | A | | 12/1986 | Samuelson |
| D361,086 | S | | 8/1995 | Thompson et al. |
| 5,468,332 | A | | 11/1995 | Dretzka et al. |
| 5,707,482 | A | * | 1/1998 | Fusselman ..... 156/577 |
| 5,759,342 | A | | 6/1998 | Luhman et al. |
| 5,815,886 | A | * | 10/1998 | Nishio et al. ..... 16/360 |
| 5,921,450 | A | * | 7/1999 | Robinson ..... 225/56 |
| D423,054 | S | | 4/2000 | Harris |
| D442,227 | S | | 5/2001 | Carlson et al. |
| D463,825 | S | | 10/2002 | Carlson et al. |
| 6,681,830 | B1 | * | 1/2004 | Vulpitta et al. ..... 156/527 |
| 6,719,180 | B2 | | 4/2004 | Shah |
| 6,789,594 | B1 | | 9/2004 | Yu Chen |
| D507,020 | S | | 7/2005 | Mueller et al. |

(Continued)

FOREIGN PATENT DOCUMENTS

| | | |
|---|---|---|
| FR | 2173453 | 10/1973 |

(Continued)

*Primary Examiner*—Kenneth E. Peterson
*Assistant Examiner*—Phong Nguyen
(74) *Attorney, Agent, or Firm*—Trisha D. Adamson

(57) ABSTRACT

The inventive tape dispenser includes a cover and a base. The cover includes a forward section, a saddle, a rounded back section, and first and second sidewalls extending downwardly from the forward section and saddle. The forward section of the cover includes a first end from which a means for cutting extends. The base includes a semicircular tape holding portion having a first side opposite a second side, a mounting surface and an inner surface. The inner surface of the base includes a means for gripping the dispenser. The base also includes an arm, a land area extending at an angle from the arm and an edge extending an angle from the land area. The edge is disposed substantially parallel to and proximate to the second sidewall of the cover.

16 Claims, 2 Drawing Sheets

U.S. PATENT DOCUMENTS

| | | | | |
|---|---|---|---|---|
| 6,923,358 | B2 | 8/2005 | Chandaria | |
| 7,021,356 | B2 * | 4/2006 | Kelders et al. | 156/523 |
| 2002/0079346 | A1 * | 6/2002 | Yu | 225/57 |
| 2003/0183344 | A1 * | 10/2003 | Lai | 156/577 |
| 2004/0154750 | A1 * | 8/2004 | Chandaria | 156/510 |
| 2006/0076384 | A1 * | 4/2006 | Dickie | 225/39 |

FOREIGN PATENT DOCUMENTS

| | | |
|---|---|---|
| JP | 2002348028 | 12/2002 |

* cited by examiner

TAPE DISPENSER

FIELD OF INVENTION

The present invention relates to a tape dispensing device, and in particular a hand held, portable, tape dispenser for dispensing a wide variety of tapes, such as packaging tapes.

BACKGROUND

There are many commercially available hand held tape dispensers. While there are also numerous disclosures regarding hand held tape dispensers, there are those in the industry who are looking for enhancements to the dispensers either functionally or aesthetically.

SUMMARY

The present invention pertains to a tape dispenser that is functional and aesthetically appealing. In one exemplary embodiment, the tape dispenser includes a cover and a base. The cover includes a forward section, a saddle, a rounded back section, and first and second sidewalls extending downwardly from at least a portion of the forward section and saddle. The saddle lies in the middle of the forward section and the rounded back section. The forward section of the cover includes a first end from which a means for cutting extends. The base includes a semicircular tape holding portion having a first side opposite a second side, a mounting surface and an inner surface. The inner surface of the base includes means for gripping the dispenser. The base also includes an arm extending from the first side of the tape holding portion. A portion of the arm is disposed substantially parallel to and proximate to the first sidewall of the cover. The base also includes a land area extending at an angle from the arm and having a leading edge disposed substantially parallel to the first end of the forward section of the cover. The base also includes an edge extending an angle from the land area, the edge disposed substantially parallel to and proximate to the second sidewall of the cover.

BRIEF DESCRIPTION OF THE DRAWINGS

The present invention will be further described with reference to the drawing figures listed below, wherein.

The drawings in the figures are not drawn to scale and are intended for illustrative purposes only.

DETAILED DESCRIPTION

Figure 1:
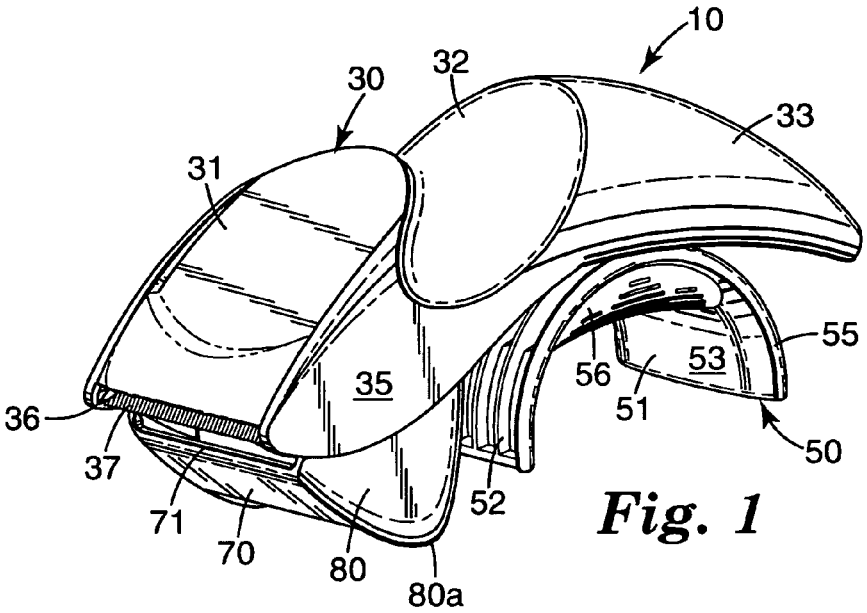
FIG. 1 is a perspective of one exemplary dispenser of the present invention.

FIG. 1 shows a perspective view of an exemplary tape dispenser of the present invention. Tape dispenser 10 includes cover 30 and base 50.

The cover includes forward section 31, saddle 32, and a rounded back section 33. As shown, the saddle, containing a concave surface, is straddled between the forward section and the rounded back section. The cover also includes a first sidewall (not shown) and second sidewall 35, both extend downwardly from at least a portion of the forward section and the saddle. The forward section has first end 36 from which means for cutting a tape extends. In FIG. 1, the means for cutting a tape is in the form of blade 37, sufficiently sharp to serrate the tape backing. The cover, particularly in the saddle and rounded back section, is sufficiently wide to wrap around the sides of a roll of tape. Thus, in this region, the cover can be described to appear like a hood over the roll of tape.

Continuing with FIG. 1, the base of the dispenser includes semicircular tape holding portion 51, an arm (not shown) that extends from the tape holding portion, land area 70 that extends at an angle, typically substantially orthogonal, from the arm, and edge 80 that extends at an angle, again typically substantially orthogonal, from the land area. The land area is substantially planar and has leading edge 71 that lies substantially parallel to the first end of the forward section of the cover. The tape holding portion has a first side (not shown) opposite second side 55, mounting surface 52 and inner surface 53. The edge has elbow 80*a* and lies on the same side of the dispenser as second side 55 of the tape holding portion. Means for gripping the dispenser extends from the inner surface of the tape holding portion. In the embodiment shown in FIG. 1, the means for gripping the dispenser is in the form of raised ridges 56, where the exposed surface of the ridges is arcuate.

Figure 2:
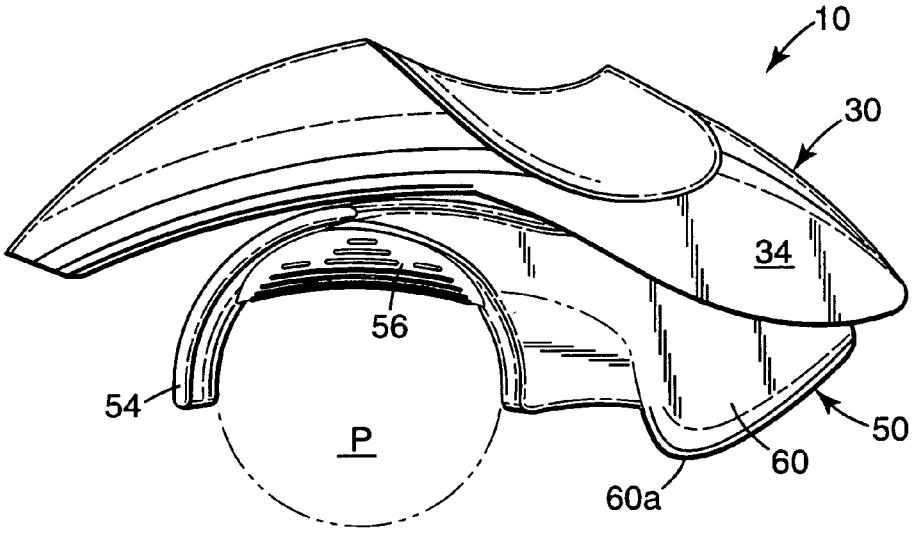
FIG. 2 is a side view of the dispenser of FIG. 1.

FIG. 2 shows a side view of the dispenser of FIG. 1, where arm 60 is shown extending from first sidewall 54 of the tape holding portion. If the circumference of the semicircular tape holding portion defines an imaginary plane P, which plane lies in the page, then the plane in which the arm lies is coincident with the plane of the circumference. The arm has an elbow 60*a*. The elbow on the arm and the elbow on the edge (shown as 80*a* in FIG. 1) are substantially similar in shape and dimension. In examining FIGS. 1 and 2, one can readily see that the arm lies on one side of the dispenser, the side that is defined by the first sidewall of the cover and the first side of the tape holding portion.

Figure 3:
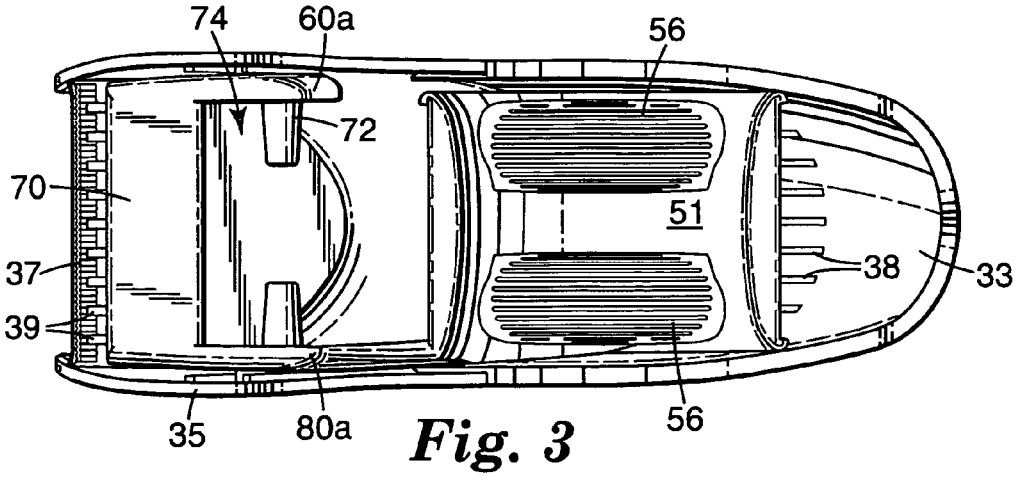
FIG. 3 is a bottom view of the dispenser of FIG. 1.

FIG. 3 shows a bottom view of the dispenser of FIG. 1 where locating tab portions 72 project towards each other. A first locating tab portion extends from the elbow, 60*a*, of the arm of the base. A second locating tab portion extends from the elbow, 80*a*, of the edge of the base. Also shown are two raised ridges, 56, on inner surface 51 of the tape holding portion.

Figure 4:
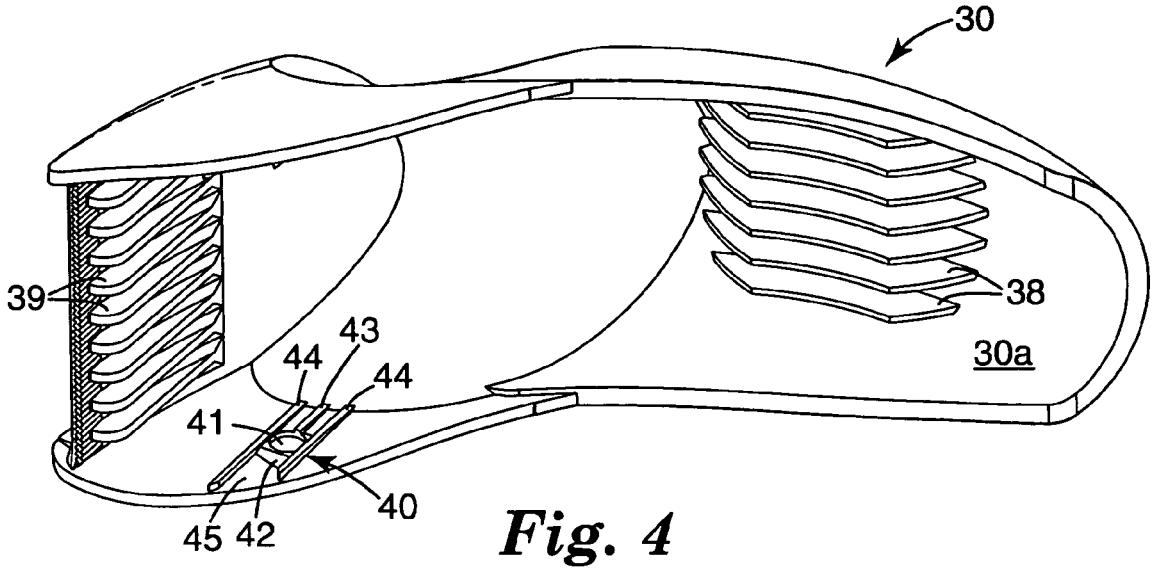
FIGS. 4 and 5 are perspective views of the dispenser of FIG. 1 that has been disassembled showing the cover 30 separate from the base 50.

FIG. 4 shows a perspective view of the inside of cover 30 of the dispenser of FIG. 1 where the cover has been disassembled from the base. The cover has 30 inside surface 30*a* that would face mounting surface 52 of the tape holding means when the cover and base are attached. In the rounded back section of the inside surface of the cover, a plurality of first ribs 38, shown spaced-apart, are present. In the forward section of the cover, a plurality second ribs 39, shown spaced-apart, is present. The forward section can further contain a plurality third ribs (not shown) that compliments the second ribs thereby allowing the blade to be retained in the cover. For example, the blade can be sandwiched between the second and third ribs and can be held therein by mechanical or adhesive means. For the firs, second, and third ribs, the number and spacing of the ribs can be varied as desired.

On the first and second sidewalls of the cover, means for attaching the cover to the base are provided. In the exemplary embodiment of FIG. 4, the means for attaching the cover to the base includes, on the cover, engaging mechanism 40 having chamfer 42 leading up to circular recessed area 41, a stop defined by bar 43, and channel 45 defined two substantially parallel bars 44. In FIG. 4, the engaging mechanism is shown on only one of the sidewalls. As can be seen, the height of bar 43 is larger than the height of circular recessed area 41. The width of channel 45 is defined by the spacing of the two substantially parallel bars 44, which width is defined by the diameter of the circular recessed area.

Figure 5:
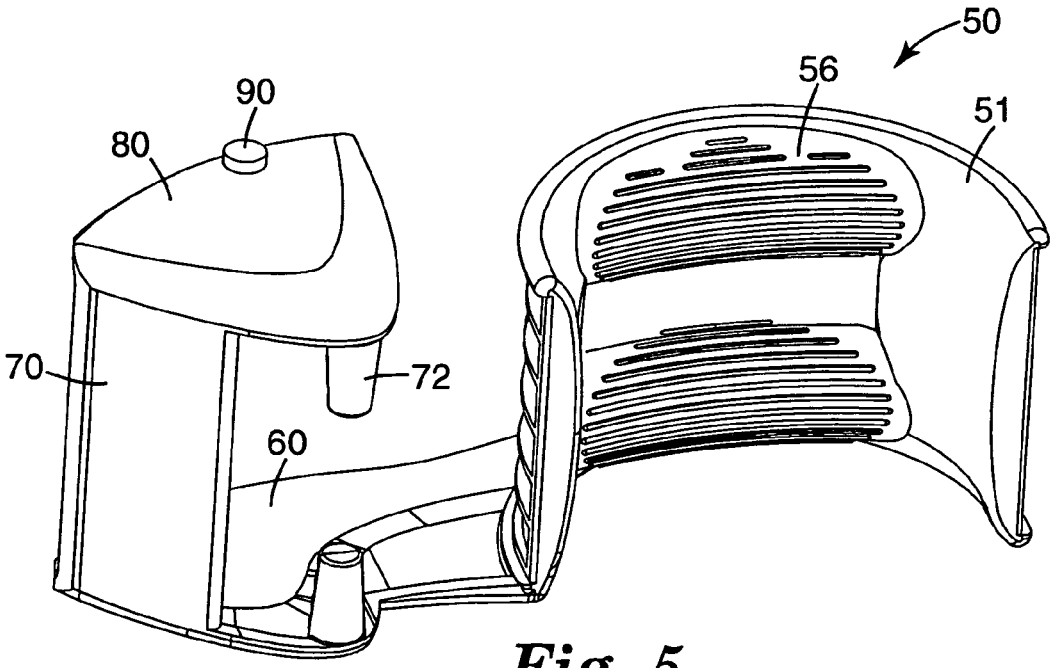

FIG. 5 shows a perspective view of the base 50 of the dispenser of FIG. 1 where the cover has been disassembled from the base. FIG. 5 shows that the base also includes pin 90 on edge 80. A similar pin (not shown) resides on the arm 60. Now referring to FIGS. 4 and 5, the dispenser can be assembled by sliding base 50 into cover 30 such that pins 90 engage channel 45 of the engaging mechanism 40 in the cover. Chamfer 42 in the cover helps pins 90 to smoothly glide into the circular recessed area 41. Bar 43 acts as a stop so that pin 90 does not accidentally or inadvertently become dislodged from the recessed area, thus minimizing the possibility of undesired disassembly of the dispenser.

A more detailed discussion of the cover and its relative position to the base is now provided. A portion of arm 50 of the base lies substantially parallel to and proximate to the first sidewall of the cover. As shown in FIG. 2, a portion of the arm is tucked inside and lies next to first sidewall 34 of the cover. Edge 80 of the base lies substantially parallel to and proximate to second sidewall 35 of the cover. The arm is on one side of the dispenser, shown in FIG. 1 as the side defined by first sidewall 34 of the cover, arm 60, and first side 54 of the tape holding portion. The second side of the dispenser, as defined by second sidewall 35 of the cover, edge 80 on the base, and second side 55 of the tape holding portion, is open, thus allowing for a roll of tape to be installed into the dispenser.

The cover and the base can be made from any suitable material, include metals, polymers, and composites thereof. In one embodiment, the cover and/or the base are integrally molded from a first polymeric material. Any polymeric material that can be injection molded is suitable for use as the cover material. An illustrative example of a suitable first polymeric material is a polymer of acrylonitrile butadiene styrene (commonly known as ABS). In another embodiment, the saddle can further contain a second polymeric material that is over-molded onto the first polymeric material of the cover. In this case, it can be desirable to have the second polymeric material to be softer, in terms of durometer, than the first polymeric material to provide an enhanced grip for the user. In yet another illustrative embodiment, at least a portion of the rounded back section includes the second, softer durometer, polymeric material. Typically, the second polymer on the rounded back section runs along the sides. An illustrative example of a suitable second polymeric material is a thermoplastic elastomer.

In use, a roll of tape is provided for mounting to the dispenser. The roll of tape has a backing having a first side opposite a second side. An adhesive, typically a pressure sensitive adhesive, is coated on the first side of the backing. If desired, a low adhesion backsize is coated on the second side of the backing, which is the "non-adhesive" side of the tape. The coated backing is wound on a core. The roll of tape, however, may be coreless, i.e., it would have an annular opening. The roll of tape is mounted in the dispenser such that the core or annular opening contacts mounting surface 52 of the tape holding portion of the base. A piece of tape is pulled from the roll and threaded through the dispenser such that the tape lies in an opening defined by locating tab portions 72 and by land area 70. In FIG. 3, the opening is generally denoted as reference number 74. The tape is then pulled up to the blade where a desired length can be dispensed.

When not in use, locating tab portions 72 keep the flapping end of the tape in an upward position so that the flap of tape will not fall back to the roll. This feature provides convenience for the user as the flap serves as a leader to help dispense additional tape. When tape is being dispensed, the adhesive side of the tape backing is exposed to the intended substrate, such as a box, and the non-adhesive side of the tape is typically in contact with the land area.

Furthermore, when the roll of tape is mounted in the dispenser, a portion of the non-adhesive side of the tape is typically in contact with ridges 38 that lie on the inside of cover 30. When desired, the user can apply pressure to rounded back section 33 of the cover thereby forcing ridges 38 against the roll of tape, thus providing a breaking action.

There are numerous ways that a user can grip the dispenser, depending on factors such as the size of the user's hand compared to the size of the dispenser. One possible placement of the user's hand, for a right handed user, would involve having the palm of the right hand on the first side of rounded back section of the cover. The fingers would wrap around one of the raised ridges while the thumb could be placed on the saddle.

Although the present invention has been described with reference to preferred embodiments, one skilled in the art will recognize that changes may be made in form and detail without departing from the spirit and scope of the invention.

What is claimed is:

1. A tape dispenser comprising:

a cover comprising a forward section, a middle saddle, a rounded back section, and first and second sidewalls extending downwardly from at least a portion of the forward section and saddle, wherein the forward section has a first end from which a means for cutting extends;

a base comprising a semicircular tape holding portion having a first side opposite a second side, a mounting surface and an inner surface, wherein the inner surface includes a means for gripping the dispenser;

an arm extending from the first side of the tape holding portion, a portion of the arm disposed substantially parallel to and proximate to the first sidewall of the cover, wherein the arm comprises a pin extending outwardly therefrom;

a land area extending at an angle from the arm and having a leading edge disposed substantially parallel to the first end of the forward section of the cover; and an edge extending at an angle from the land area, the edge disposed substantially parallel to and proximate to the second sidewall of the cover, wherein the edge comprises a pin extending outwardly therefrom;

wherein each of the first and second sidewalls comprises a chamfer leading up to a circular recess area and a stop, in the form of a raised bar having a height that is larger than the height of the circular recesses area, that lies along the circumference of the circular recessed area directly opposite to the chamfer;

wherein the base is connected to the cover such that the pin of the arm is proximate the circular recessed area of the first side wall of the cover and the pin of the edge is proximate the circular recessed area of the second side wall of the cover.

2. The tape dispenser of claim 1, wherein the saddle of the cover includes a concave surface.

3. The tape dispenser of claim 1, wherein the at least one of the base and the cover is integrally molded from a first polymeric material.

4. The tape dispenser of claim 3, wherein the first polymeric material is acrylonitrile butadiene styrene.

5. The tape dispenser of claim 3, wherein at least one of the saddle and the rounded back of the cover comprises a second polymeric material that is softer in durometer than the first polymeric material.

6. The tape dispenser of claim 1, wherein in the base, the land area extends substantially orthogonal to the arm and is of a length that is less than the distance between the first and second sidewalls of the cover, and wherein the edge extends substantially orthogonal to the land area.

7. The tape dispenser of claim 1, wherein the land area is substantially planar.

8. The tape dispenser of claim 1, wherein in the base, the arm has an elbow and the edge has an elbow, wherein each elbow is substantially similar in shape and dimensions.

9. The tape dispenser of claim 8, wherein the base further comprises two locating tab portions projecting towards each other, the first locating tab portion extending from the elbow of the arm, the second locating tab portion extending from the elbow of the edge.

10. The tape dispenser of claim 1, wherein the cover further comprises a plurality of ribs proximate to the first end of the forward section and wherein the ribs retain the means for cutting the tape.

11. The tape dispenser of claim 1, wherein in the cover, a portion of the saddle and a portion of the rounded back is sufficiently wide to cover the width of a roll of tape.

12. The tape dispenser of claim 1, wherein in the base, the arm and the edge comprises means for attaching the base to the cover and the cover further comprises means for receiving the base.

13. The tape dispenser of claim 1, wherein the chamfer comprises a channel defined by two substantially parallel bars, the spacing of the two substantially parallel bars being defined by the diameter of the circular recessed area.

14. The tape dispenser of claim 1, wherein in the base, the means for gripping the dispenser comprises raised ridges having an exposed arcuate surface.

15. The tape dispenser of claim 14 comprising two raised ridges.

16. The tape dispenser of claim 1, wherein the cover has an inside surface facing towards the mounting surface of the tape holding portion of the base, the inside surface of the cover in the rounded back section contains a plurality of ribs.

* * * * *